US010974250B2

(12) United States Patent
Zhang et al.

(10) Patent No.: US 10,974,250 B2
(45) Date of Patent: Apr. 13, 2021

(54) 3D-SLANTED ROLL CRUSHER

(71) Applicant: NINGXIA TIANDI BENNIU INDUSTRIAL GROUP CO., LTD., Shizuishan (CN)

(72) Inventors: Lin Zhang, Shizuishan (CN); Jian-Wei Yan, Shizuishan (CN); Yang Li, Shizuishan (CN); Chun-Sheng Wang, Shizuishan (CN); Zhen-Qian Wang, Shizuishan (CN); Qing-Hua Liu, Shizuishan (CN); Jin-Jun Wang, Shizuishan (CN)

(73) Assignee: NINGXIA TIANDI BENNIU INDUSTRIAL GROUP CO., LTD., Shizuishan (CN)

( * ) Notice: Subject to any disclaimer, the term of this patent is extended or adjusted under 35 U.S.C. 154(b) by 151 days.

(21) Appl. No.: 16/232,848

(22) Filed: Dec. 26, 2018

(65) Prior Publication Data

US 2019/0126282 A1 May 2, 2019

Related U.S. Application Data

(63) Continuation-in-part of application No. PCT/CN2016/110866, filed on Dec. 19, 2016.

(30) Foreign Application Priority Data

Dec. 5, 2016 (CN) ..... 201611104072.6

(51) Int. Cl.
*B02C 4/08* (2006.01)
*B02C 4/42* (2006.01)
(Continued)

(52) U.S. Cl.
CPC ..... *B02C 4/08* (2013.01); *B02C 4/02* (2013.01); *B02C 4/28* (2013.01); *B02C 4/30* (2013.01); *B02C 4/42* (2013.01)

(58) Field of Classification Search
CPC .... B02C 4/08; B02C 4/02; B02C 4/28; B02C 4/30; B02C 4/42
(Continued)

(56) References Cited

U.S. PATENT DOCUMENTS 4,067,503 A * 1/1978 Broman ..... B02C 15/04 241/117

FOREIGN PATENT DOCUMENTS

CN 2801280 Y * 8/2006
CN 2801280 Y 8/2006
(Continued)

OTHER PUBLICATIONS

Translation of CN 2801280 (Year: 2006).*

*Primary Examiner* — Teresa M Ekiert
*Assistant Examiner* — Teresa A Guthrie
(74) *Attorney, Agent, or Firm* — ScienBiziP, P.C.

(57) ABSTRACT

A 3D-slanted roll crusher includes a housing, a number of driving devices mounted to the housing, a base mounted to an end of the housing away from the driving devices, a number of groups of grinders, a number of grinding teeth mounted on each of the grinders, and a number of material obstructing bodies mounted on an inner wall of the housing. The grinders correspond to the driving members one-to-one. Each grinder is connected to the base and the corresponding driving device. The grinders are spaced equally apart within the housing around a central axis of the housing and slantedly mounted on the base facing the driving devices.

13 Claims, 7 Drawing Sheets

(51) Int. Cl.
*B02C 4/30* (2006.01)
*B02C 4/28* (2006.01)
*B02C 4/02* (2006.01)

(58) Field of Classification Search
USPC ..... 241/229, 165.5, 236
See application file for complete search history.

(56) References Cited

FOREIGN PATENT DOCUMENTS

| | | | | | |
|---|---|---|---|---|---|
| CN | 206404841 | U | | 8/2017 | |
| DE | 2609661 | A1 | | 10/1976 | |
| GB | 754724 | A | * | 8/1956 | ..... B02C 15/001 |

* cited by examiner

3D-SLANTED ROLL CRUSHER

FIELD

The subject matter herein generally relates to grinding devices for use in mines, and more particularly to a 3D-slanted roll crusher for grinding coal and similar materials.

BACKGROUND

Current equipment used for grinding coal and other materials generally use a roll crusher having two grinders. Common roll crushers using two grinders have the two grinders arranged parallel to each other and configured to rotate in opposite directions to grind large pieces of material not capable of falling through a gap between the two grinders.

Therefore, because the two grinders are arranged parallel to each other, filtering is only done along one plane, long pieces of material are easy to slip past, and a particle size of the ground material can only be controlled in two dimensions. Thus, efficiency is limited. Because a large area of space for outputting the ground material is taken up by the two grinders, an efficiency of filtering the ground material is not high. Thus, the material is easy to jam. Because the two grinders use cutting devices, a size of the material to be ground is limited by a size of the cutting devices of the two grinders, which results in a small grinding size.

In view of the description above, the present disclosure provides a 3D slanted grinding device having large grinding size and a high grinding efficiency.

To realize the purpose of the present disclosure, the present disclosure uses the embodiment as described below.

A 3D-slanted grinding device includes a housing, a plurality of driving devices mounted to the housing, a base mounted to an end of the housing away from the driving devices, a plurality of groups of grinders, a plurality of grinding teeth mounted on each of the grinders, and a plurality of material obstructing bodies mounted on an inner wall of the housing. The grinders correspond to the driving members one-to-one.

Each grinder is connected to the base and the corresponding driving device. The grinders are spaced equally apart within the housing around a central axis of the housing and slantedly mounted on the base facing the driving device.

The 3D-slanted grinding device of the present embodiment uses the housing cooperatively arranged with the grinders. A slanted space arranged of the grinders achieves a large grinding size, high filtering efficiency, increased processing ability, and 3D grinding characteristics to increase the grinding efficiency and grinding quality.

In one embodiment, the grinders surround a central axis of the housing and are slantedly mounted in a clockwise-slanted orientation or in a counterclockwise-slanted orientation on the base facing the driving members.

In one embodiment, the grinders are mounted as longitudinal cylinders. A slanted angle of an axis of each grinder relative to the base is the same. An angle of a projection of the axis of each grinder on the base is 34-86 degrees.

In one embodiment, the grinder includes a first end portion and an opposite second end portion. The first end portion is connected to the driving device, and the second end portion is connected to the base through a bottom bearing component.

In one embodiment, a distance between a center of a top of the first end portion of each grinder and a central axis of the housing is greater than a distance between a center of a bottom of the second end portion and the central axis of the housing.

In one embodiment, a distance between a center of a top of the first end portion of each grinder and a central axis of the housing is greater than a distance between a center of a bottom of the second end portion and the central axis of the housing.

In one embodiment, the distance between the center of the top of the first end portion of each grinder and the central axis of the housing is the same, and the distance between the center of the bottom of the second end portion and the central axis of the housing is the same.

In one embodiment, the center of the top of the first end portion of each grinder is encompassed by a same circle A, and the centers of the tops of the first end portions of the grinders are equally spaced apart around the central axis of the housing. The center of the bottom of the second end portion of each grinder is encompassed by a same circle B, and the centers of the bottoms of the second end portions of the grinders are equally spaced apart around the central axis of the housing. A radius of the circle A is greater than a radius of the circle B.

In one embodiment, a quantity of the grinders is three, a quantity of the driving devices is three, and a quantity of the material obstructing bodies is three. Each material obstructing body extends as a slanted spiral. Each obstructing body corresponds to an adjacent one of the grinders and is spaced a predetermined distance from an outer profile of the corresponding grinder to form an annular space.

In one embodiment, the housing is a hollow circular column. An outer wall of a top of the housing includes three spaced apart mounting steps. Each mounting step mounts a corresponding one of the driving devices. The housing is made of three identical arcuate pieces having an arc of 120 degrees.

A 3D-slanted roll crusher includes a housing, at least three driving devices mounted on the housing, a base located at an end of the housing away from the driving devices, at least three grinders, a plurality of grinding teeth mounted on each grinder, and a plurality of material obstructing bodies mounted to an inner wall of the housing. The grinders correspond to the driving devices one-to-one. Each grinder is connected to the base and a corresponding one of the driving devices. The grinders are spaced equally apart within the housing around a central axis of the housing and slantedly mounted on the base facing the driving devices. The housing is a hollow circular column. An outer wall of a top of the housing includes three spaced apart mounting steps. Each mounting step mounts a corresponding one of the driving devices.

Figure 1:
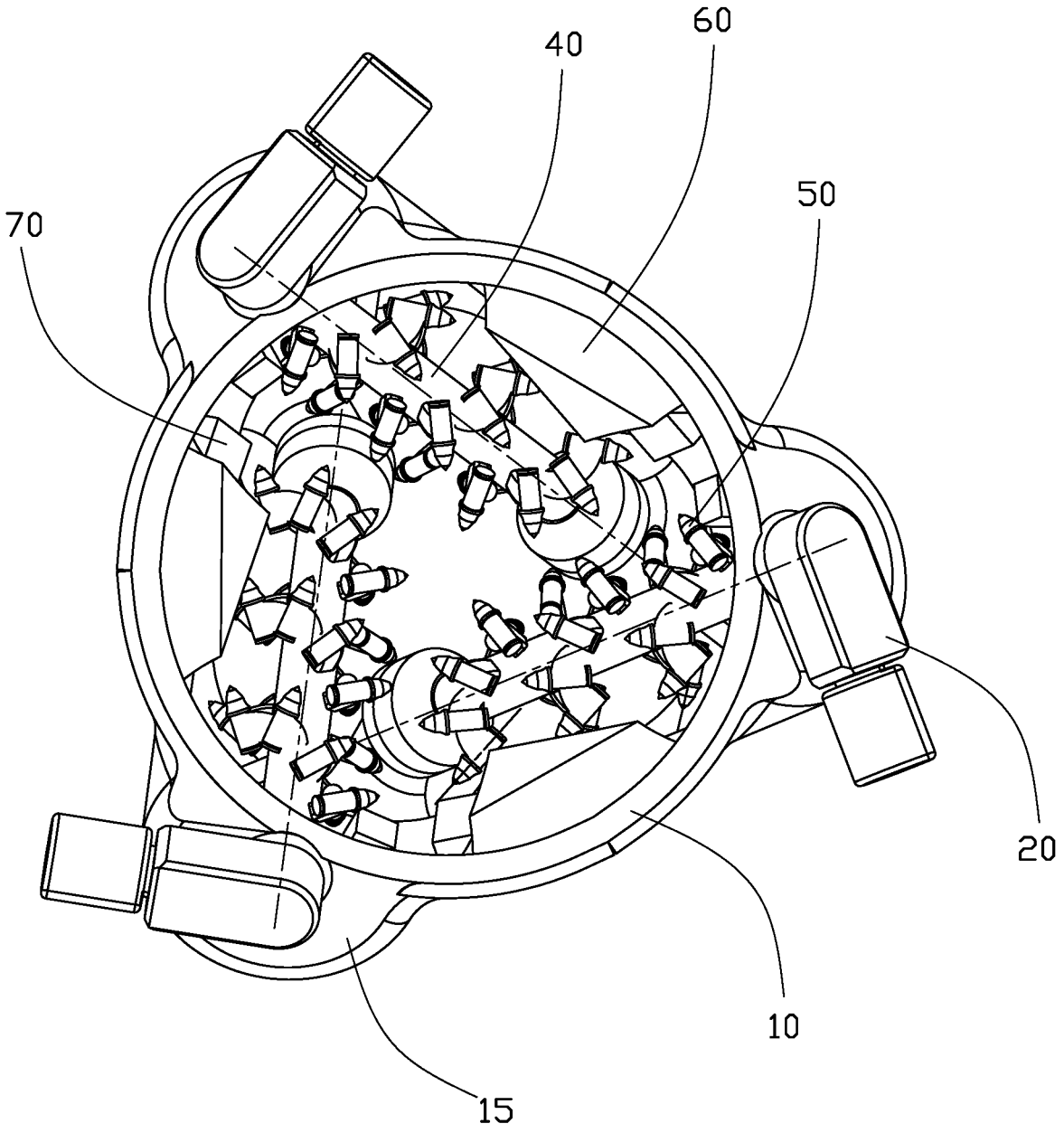
FIG. 1 is a top view of a 3D-slanted roll crusher of the present disclosure.

In the figures: housing 10, mounting step 15, bearing component 19, driving device 20, motor 21, speed reducer 22, base 30, grinders 40, first end portion 41, connecting teeth 410, step portion 415, second end portion 42, step portion 420, grinding teeth 50, material obstructing body 60, material obstructing teeth 70.

DETAILED DESCRIPTION

For simplicity of understanding the present disclosure, the present disclosure is more fully described below. However, the present disclosure can be carried out in various embodiments and is not limited to the embodiments described herein. On the contrary, the purpose of the embodiments presented is to provide a more thorough understanding of the contents of the present disclosure.

Unless otherwise specified, the terms used in the present disclosure have the same meanings recognized by those in the art. The terms used in the present disclosure are for describing detailed embodiments, not for limiting the scope of the present disclosure.

FIGS. 1-7 show an exemplary embodiment of a 3D-slanted roll crusher for grinding coal and similar materials. The 3D-slanted roll crusher includes a housing 10, three driving devices 20 mounted to the housing 10, a base 30 located at an end of the housing 10 away from the driving devices 20, three groups of grinders 40, a plurality of grinding teeth mounted to each grinder 40, a plurality of material obstructing bodies 60 mounted to an inner wall of the housing 10, and a plurality of material obstructing teeth 70 mounted to the material obstructing bodies 60. Each grinder 40 is connected to the base 30 and a corresponding one of the driving devices 20. The grinders 40 are spaced equally apart within the housing 10 around a central axis of the housing 10 and are slantedly mounted on the base 30 facing the driving devices 20. In detail, the grinders 40 surrounding the central axis of the housing 10 and slantedly mounted on the base 30 facing the driving members 20 are mounted in a same slanted direction (clockwise-slanted orientation or counterclockwise-slanted orientation).

Figure 2:
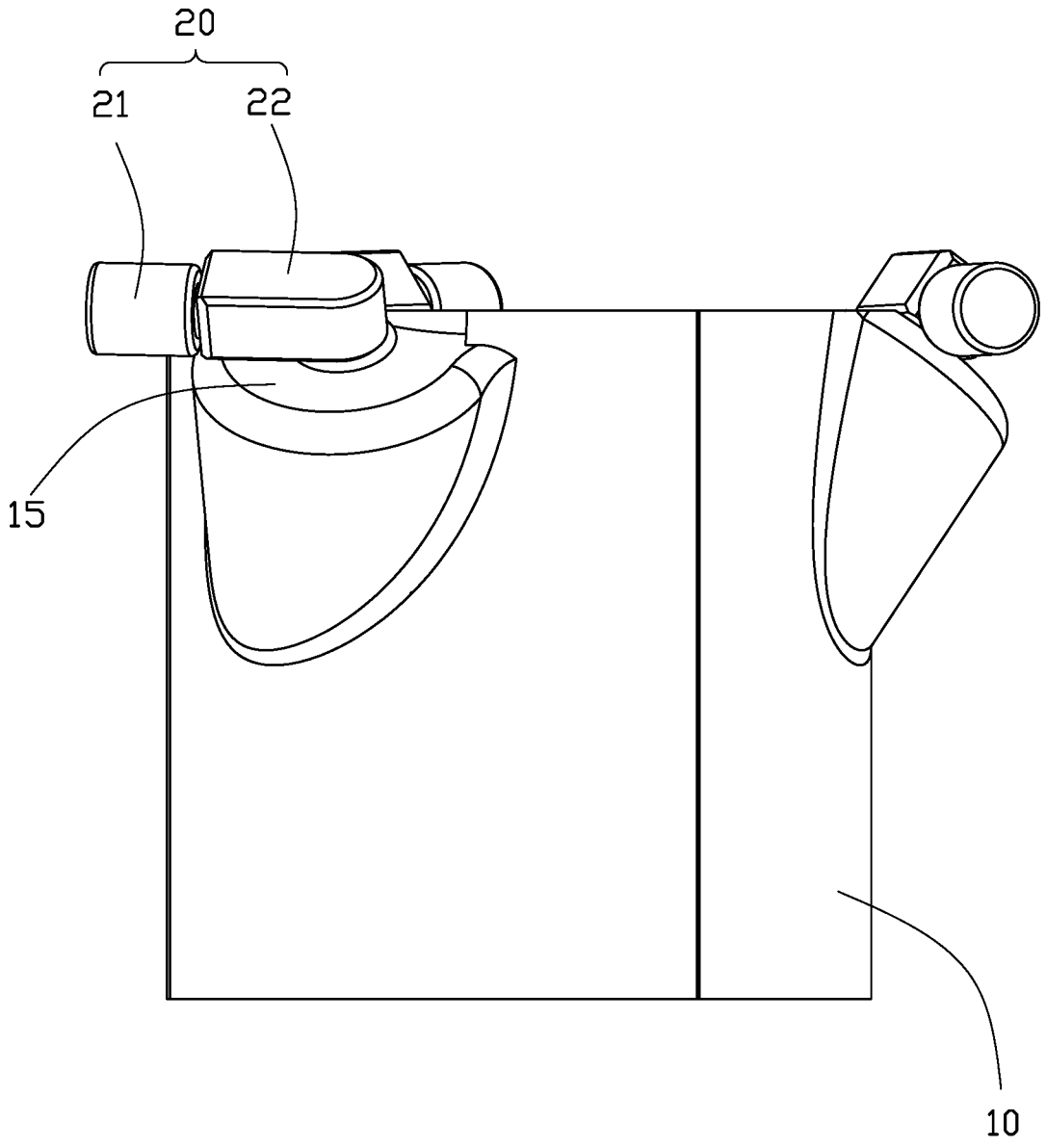
FIG. 2 is a front view of the 3D-slanted roll crusher in FIG. 1.

With reference to FIG. 1 and FIG. 2, the housing 10 is a hollow circular column. An outer wall of a top of the housing 10 includes three spaced apart mounting steps 15. In detail, each mounting step 15 surrounds the axis of the housing 10 and are spaced 120 degrees apart from each other. In the present embodiment, the housing 10 is made of three identical arcuate pieces having an arc of 120 degrees for convenient manufacturing. Each mounting step 15 is located on a corresponding one of the arcuate pieces. It should be understood that in other embodiments, the housing 10 can be integrally formed. An inner side of the mounting step 15 of the housing 10 mounts a top portion bearing component 19 for mounting the corresponding grinder 40.

Each driving device 20 is mounted on the corresponding mounting step 15 of the housing 10. The driving device 20 includes a motor 21, a speed reducer 22, and a shaft coupler (not shown). Each driving device 20 is connected to the corresponding grinder 40 to drive the grinder 40 to rotate.

Figure 3:
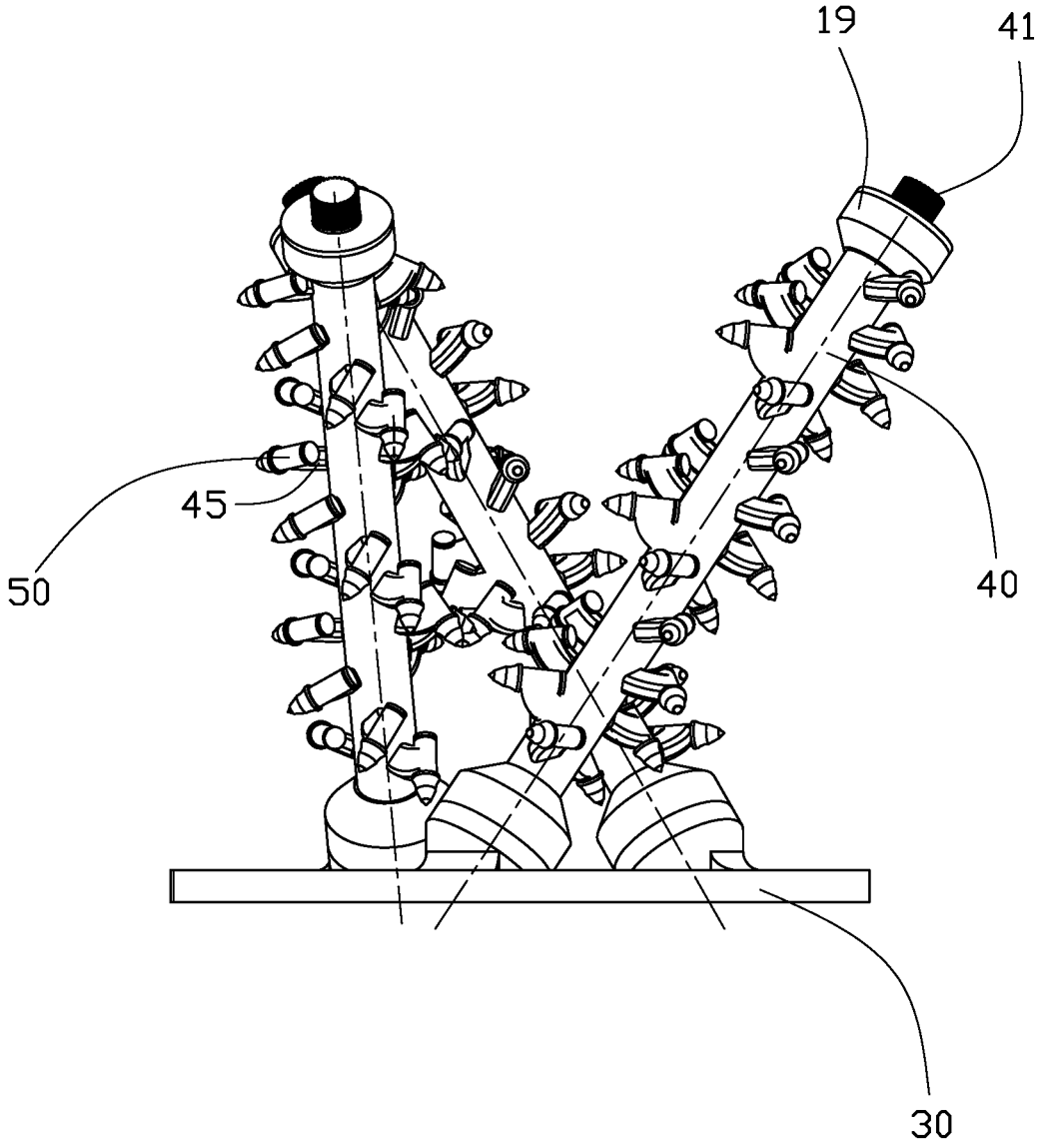
FIG. 3 is a schematic diagram showing a base, grinders, and grinding teeth of the 3D-slanted roll crusher in FIG. 2.
Figure 4:
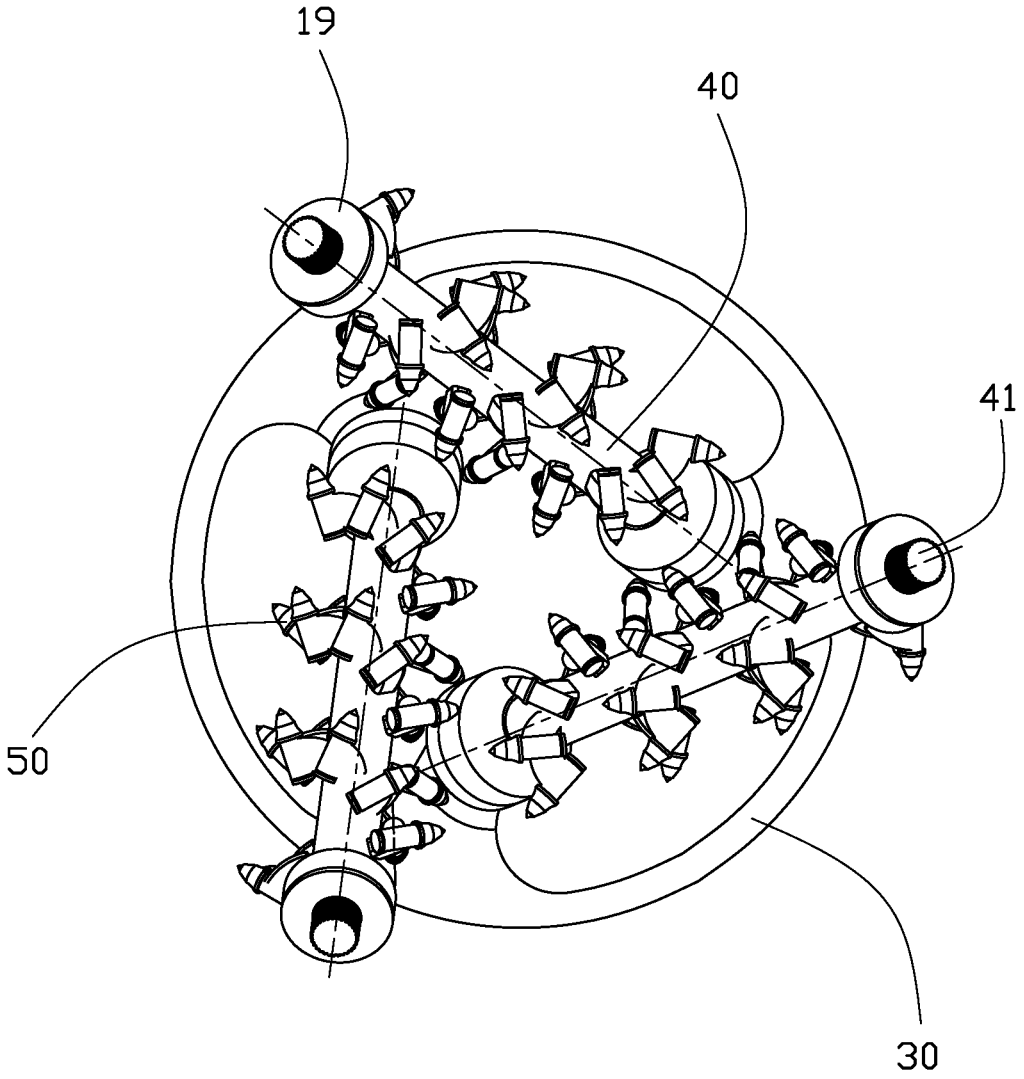
FIG. 4 is a top view of the 3D-slanted roll crusher in FIG. 3.

With reference to FIG. 3 and FIG. 4, the base 30 is located at an end of the housing 10 away from the driving devices 20. The base 30 of the present disclosure is located at a bottom end of the housing 10. The base 30 is annular. A middle portion of the base 30 is hollowed out to allow ground up material to fall through. The base 30 has mounted thereon three bottom bearing groups (not labeled) each mounting a corresponding one of the grinders 40. A bottom portion of the base 30 can have a tray according to requirements, and a top surface can have adhered thereto an anti-wear plate to ensure stiffness and wear-resistance of the base 30.

The grinders 40 are mounted as longitudinal cylinders and include a first end portion 41 and a second end portion 42. In the present embodiment, the first end portion 41 is a top end of the grinder 40, and the second end portion 42 is a bottom end of the grinder 40. The first end portion 41 includes connecting teeth 410 to connect to a corresponding one of the driving devices 20. A portion of the first end portion 41 located below the connecting teeth 410 includes a step portion 415 to mount the bearing component 19. The second end portion 42 includes a step portion 420 to connect to the bottom bearing group.

Figure 5:
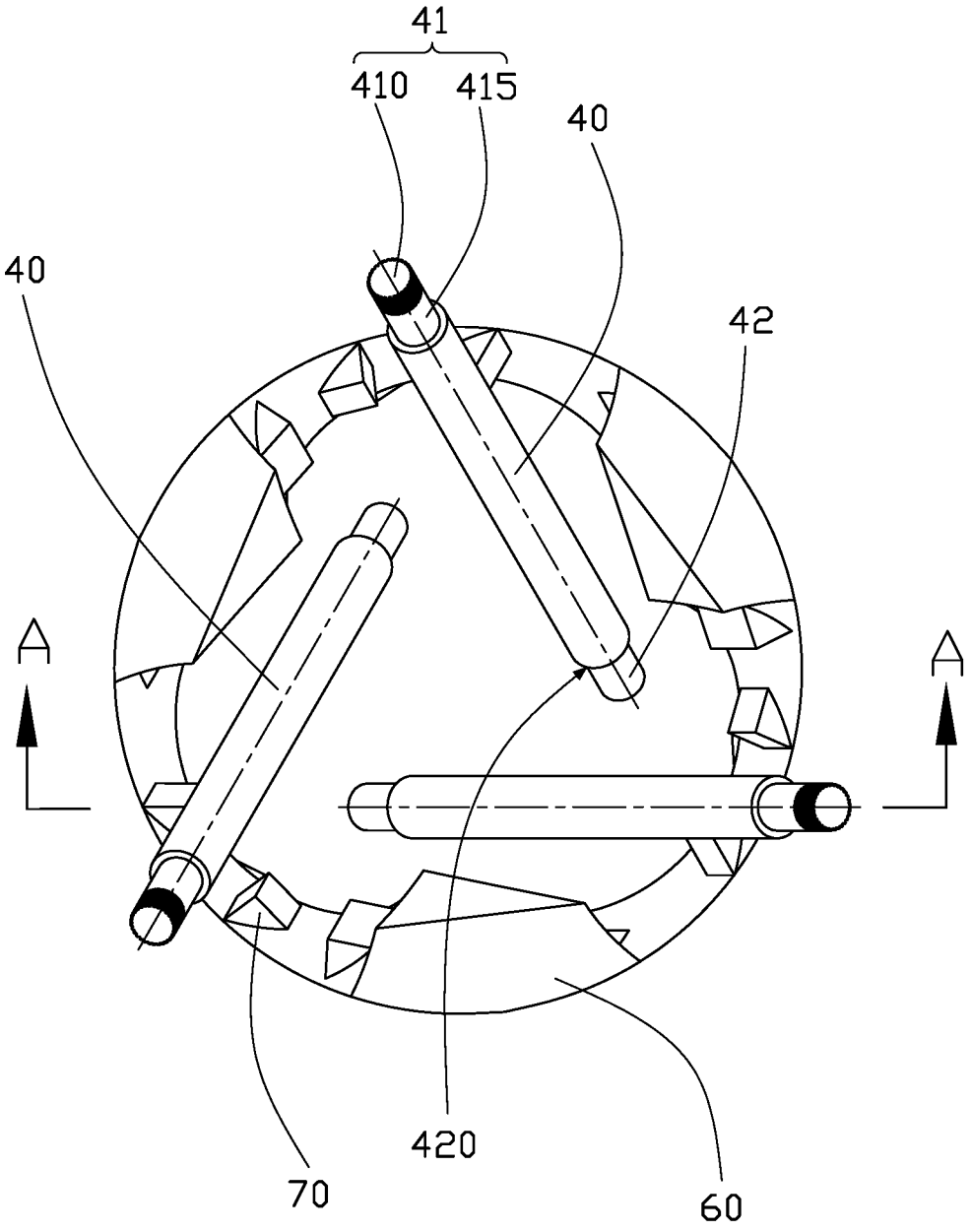
FIG. 5 is a schematic diagram of the 3D-slanted roll crusher in FIG. 1 showing the base, the grinders, a material obstructing body, and material obstructing teeth.
Figure 6:
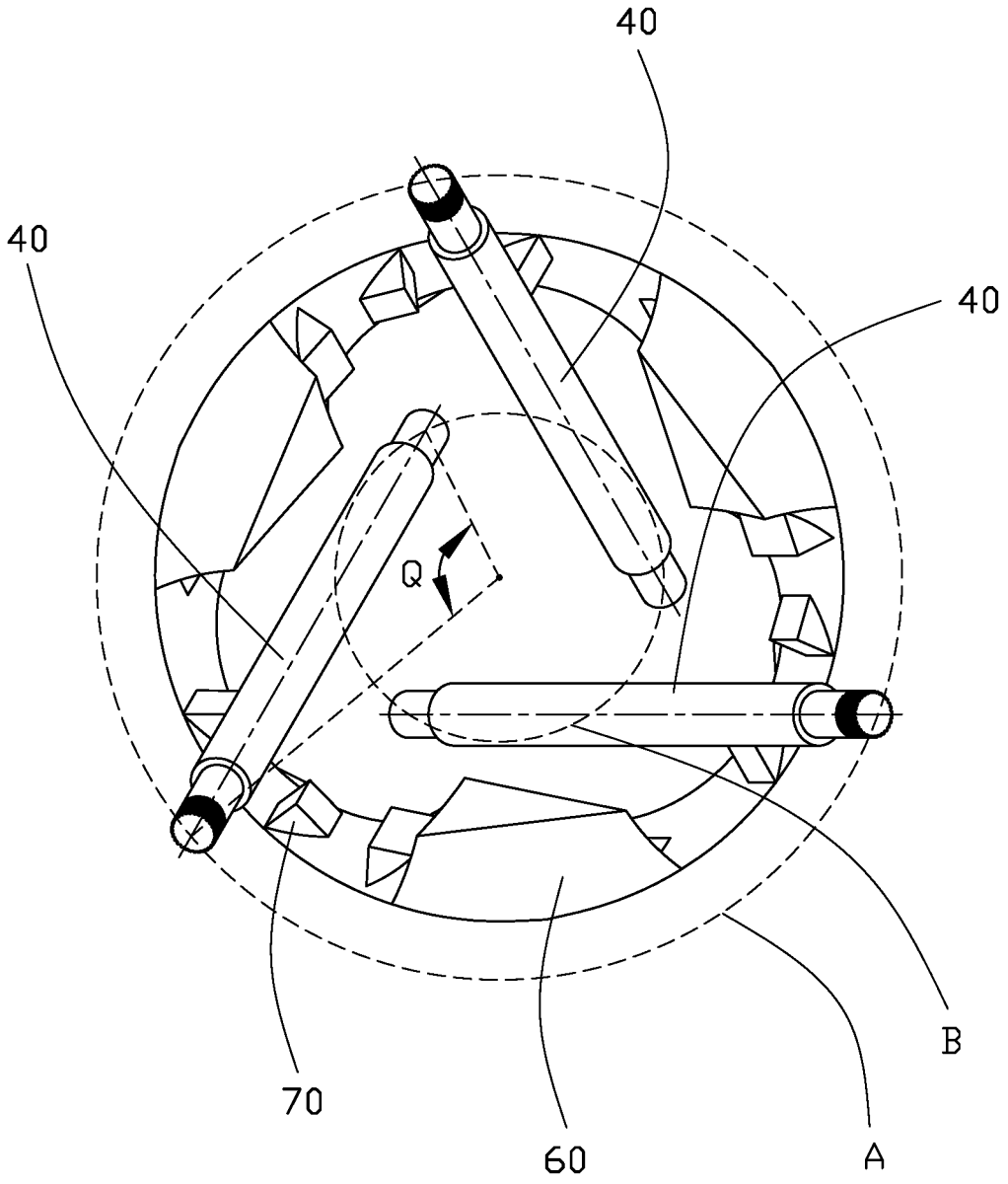
FIG. 6 is a schematic diagram showing schematic lines and angle lines in FIG. 5.
Figure 7:
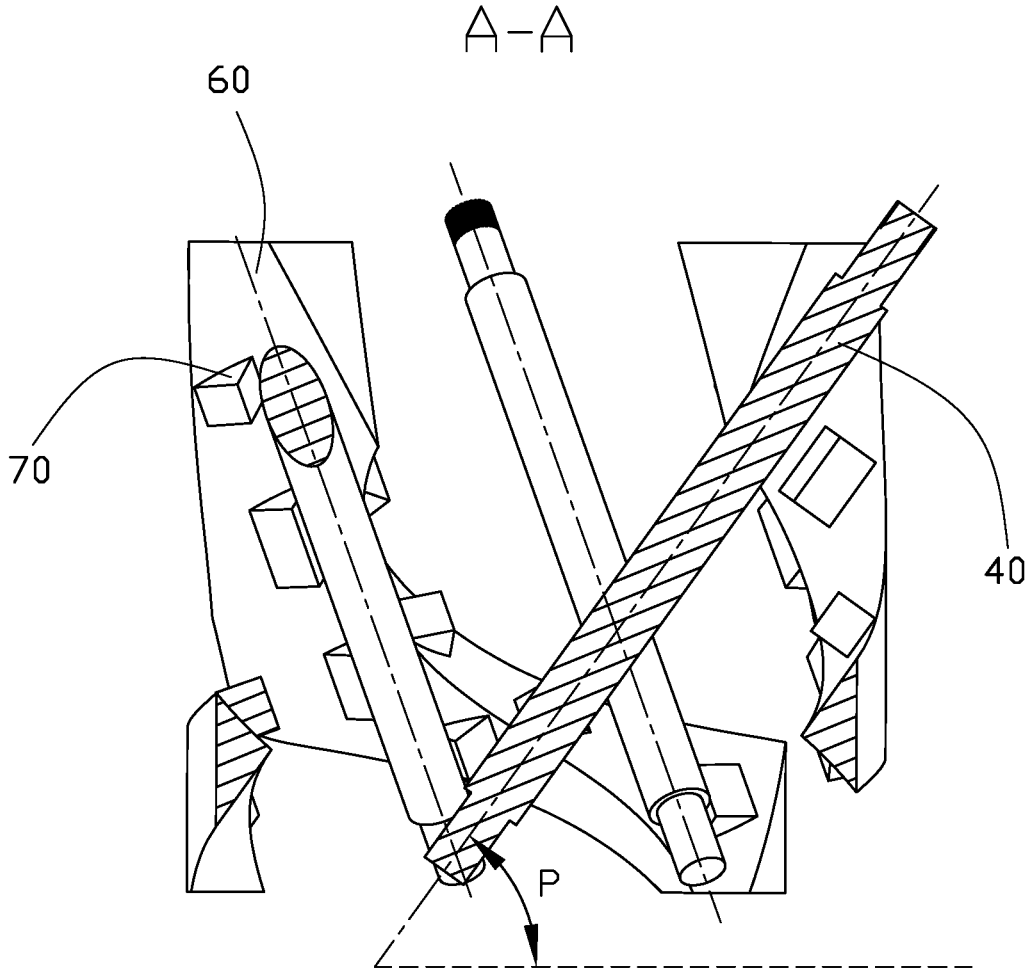
FIG. 7 is a cross-sectional diagram of the 3D-slanted roll crusher taken along line A-A in FIG. 5.

With reference to FIGS. 5-7, the grinders 40 surrounding the central axis of the housing 10 and slantedly mounted on the base 30 facing the driving members 20 are mounted in a clockwise-slanted orientation or in a counterclockwise-slanted orientation. A distance between a center of a top of the first end portion 41 of each grinder 40 and a central axis of the housing 10 is greater than a distance between a center of a bottom of the second end portion 42 and the central axis of the housing 10. Each grinder 40 is slanted relative to a top surface of the base 30. A slanted angle between an axis of each grinder 40 and the base 30 is the same. In detail, an angle of a projection of the axis of each grinder 40 on the base 30 is defined as P. A range of P is 34-86 degrees, preferably 54 degrees. An angle defined between a perpendicular line between the center of the top of the first end portion 41 of each grinder 40 and the central axis of the housing 10 and a perpendicular line between the center of the bottom of the second end portion 42 of each grinder 40 and the central axis of the housing 10 is defined as Q. A range of Q is 63-153 degrees, preferably 103 degrees. The angle Q of each grinder 40 is the same.

In the present disclosure, a distance between the center of the top of the first end portion 41 of each grinder 40 and the central axis of the housing 10 is the same, and a distance between the center of the bottom of the second end portion 42 and the central axis of the housing 10 is the same. The center of the top of the first end portion 41 of each grinder 40 is encompassed by a same circle A, and the centers of the tops of the first end portions 41 of the grinders 40 are equally spaced apart around the central axis of the housing 10. The center of the bottom of the second end portion 42 of each grinder 40 is encompassed by a same circle B, and the centers of the bottoms of the second end portions 42 of the grinders 40 are equally spaced apart around the central axis of the housing 10. A radius of the circle A is greater than a radius of the circle B.

The grinding teeth 50 are shaped as spirals and spaced apart on an outer wall of the grinders 40. A teeth base 45 is mounted on each grinder 40. The grinding teeth 50 are mounted onto the grinders 40 by the teeth base 45. The grinding teeth 50 can be changed when they show signs of wear. In the present disclosure, the grinding teeth 50 are pick-shaped, and a mounting angle is directed outside for suitably grinding material according to requirements.

The material obstructing body 60 is mounted to an inner wall of the housing 10. A quantity of the material obstructing body 60 is three. Each material obstructing body 60 is slanted spiral-shaped and is adjacent to a corresponding one of the grinders 40. Each material obstructing body 60 maintains a predetermined distance from an outer profile of the adjacent grinder 40 to define an annular space, thereby controlling a particle size of ground material. The material obstructing body 60 includes a spiral edge to increase a grinding efficiency. In the present disclosure, the material obstructing body 60 is mounted to the housing 10 by riveting and screwing methods. The material obstructing teeth 70 are mounted spaced apart on an inner wall of the material obstructing body 60 to assist the grinders 40 in grinding material, thereby maintaining a particle size and grinding effect.

In operation, the 3D-slanted roll crusher of the present disclosure is used in a standing position, and the grinders 40 are arranged in a helical fashion within the housing 10. The driving devices 20 drive the grinders 40 to rotate, thereby driving the grinding teeth 50 to grind material inserted into the housing 10.

In the 3D-slanted roll crusher of the present disclosure, because the space of the grinders is arranged in a helical fashion, the grinders minimally obstruct the material, therefore filtering and grinding processes are carried out utilizing the entire length of the roll crusher, having less accumulation of the material. Also, because the material is moved along an arcuate path, long pieces of material are prevented from slipping through by the grinding action of the grinding teeth, and the particle size of the ground material is controlled in 3D space. The grinders arranged in a helical fashion approximate a cone-shaped material feed space, and feed material size is not limited by the grinding teeth to achieve a greater ratio of reduction.

The 3D-slanted roll crusher as described above has a high ratio of reduction, high filtering efficiency, high processing ability, and 3D grinding characteristics to enhance grinding efficiency and grinding quality.

It should be understood that the quantity of the grinders of the 3D-slanted roll crusher is not limited to three. The quantity of the grinders can also be four, five, etc. as long as there are at least three. The quantity of the driving devices is the same as the quantity of the grinders and correspond one-to-one. The grinders surround the central axis of the housing and are equally spaced apart within the housing and can achieve 3D grinding and high grinding efficiency.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A 3D-slanted roll crusher comprising:

a housing made of a plurality of identical arcuate pieces separated from each other, each arcuate piece having an arc of 120 degrees;

a plurality of driving devices, each driving device mounted to one arcuate piece of the housing;

a base mounted to an end of the housing away from the driving devices;

a plurality of groups of grinders;

a plurality of grinding teeth mounted on each of the grinders; and a plurality of material obstructing bodies mounted on an inner wall of the housing;

wherein the grinders correspond to the driving devices one-to-one; each grinder comprises a first end portion and a second end portion opposite to the first end portion, the first end portion is connected to the corresponding driving device, the second end portion is connected to the base; the grinders are spaced equally apart within the housing around a central axis of the housing, and extend from the base towards the driving devices in a clockwise-slanted orientation or in a counterclockwise-slanted orientation, an angle defined by a perpendicular line between a top of the first end portion of each grinder and the central axis and a perpendicular line between a bottom of the second end portion of the grinder and the central axis is greater than 0 degree.

2. The 3D-slanted roll crusher of claim 1, wherein each grinder is a cylinder; a slanted angle of an axis of each grinder relative to the base is the same; an angle between a projection of the axis of each grinder on the base and an axis of a corresponding grinder is 34-86 degrees.

3. The 3D-slanted roll crusher of claim 1, wherein the second end portion is connected to the base through a bottom bearing component.

4. The 3D-slanted roll crusher of claim 3, wherein a distance between a center of the top of the first end portion of each grinder and the central axis of the housing is greater than a distance between a center of the bottom of the second end portion and the central axis of the housing.

5. The 3D-slanted roll crusher of claim 3, wherein a distance between a center of the top of the first end portion of each grinder and the central axis of the housing is the same, and a distance between a center of the bottom of the second end portion and the central axis of the housing is the same.

6. The 3D-slanted roll crusher of claim 3, wherein a center of the top of the first end portion of each grinder is encompassed by a same circle A, and the centers of the tops of the first end portions of the grinders are equally spaced apart around the central axis of the housing; a center of the bottom of the second end portion of each grinder is encompassed by a same circle B, and the centers of the bottoms of the second end portions of the grinders are equally spaced apart around the central axis of the housing; a radius of the circle A is greater than a radius of the circle B.

7. The 3D-slanted roll crusher of claim 3, wherein: a quantity of the grinders is three, a quantity of the driving devices is three, a quantity of the material obstructing bodies is three; each material obstructing body extends as a slanted spiral; each obstructing body corresponds to an adjacent one of the grinders and is spaced a predetermined distance from an outer profile of the corresponding grinder to form an annular space.

8. The 3D-slanted roll crusher of claim 7, wherein the housing is a hollow circular column; an outer wall of a top of the housing comprises three mounting steps spaced apart from each other, each mounting step mounting a corresponding one of the driving devices.

9. A 3D-slanted roll crusher comprising:

a housing made of a plurality of identical arcuate pieces separated from each other, each arcuate piece having an arc of 120 degrees;

at least three driving devices mounted on the housing;

a base located at an end of the housing away from the driving devices;

at least three grinders, each driving device mounted to one arcuate piece of the housing;

a plurality of grinding teeth mounted on each grinder; and a plurality of material obstructing bodies mounted to an inner wall of the housing;

wherein the grinders correspond to the driving devices one-to-one; each grinder comprises a first end portion and a second end portion opposite to the first end portion, the first end portion is connected to the corresponding driving device, the second end portion is connected to the base; the grinders are spaced equally apart within the housing around a central axis of the housing, and extend from the base towards the driving devices in a clockwise-slanted orientation or in a counterclockwise-slanted orientation, an angle defined by a perpendicular line between a top of the first end portion of each grinder and the central axis and a perpendicular line between a bottom of the second end portion of the grinder and the central axis is greater than 0 degree;

wherein the housing is a hollow circular column; an outer wall of a top of the housing comprises three spaced apart mounting steps, each mounting step mounting a corresponding one of the driving devices.

10. The 3D-slanted roll crusher of claim 1, wherein the angle defined between the two perpendicular lines is from 63 degrees to 153 degrees.

11. The 3D-slanted roll crusher of claim 9, wherein the angle defined between the two perpendicular lines is from 63 degrees to 153 degrees.

12. The 3D-slanted roll crusher of claim 1, wherein the grinders are arranged in a helical fashion, which form a cone-shaped material feed space.

13. The 3D-slanted roll crusher of claim 9, wherein the grinders are arranged in a helical fashion, which form a cone-shaped material feed space.

* * * * *